US011242214B2

(12) United States Patent
Osterhout

(10) Patent No.: US 11,242,214 B2
(45) Date of Patent: Feb. 8, 2022

(54) CONVERTING MACHINE WITH FOLD SENSING MECHANISM

(71) Applicant: Packsize LLC, Salt Lake City, UT (US)

(72) Inventor: Ryan Osterhout, West Haven, UT (US)

(73) Assignee: PACKSIZE LLC, Salt Lake City, UT (US)

( * ) Notice: Subject to any disclaimer, the term of this patent is extended or adjusted under 35 U.S.C. 154(b) by 208 days.

(21) Appl. No.: 15/872,770

(22) Filed: Jan. 16, 2018

(65) Prior Publication Data

US 2018/0201465 A1 Jul. 19, 2018

Related U.S. Application Data

(60) Provisional application No. 62/447,714, filed on Jan. 18, 2017.

(51) Int. Cl.

| | |
|---|---|
| ***B65H 45/00*** | (2006.01) |
| ***B65H 45/101*** | (2006.01) |
| ***B65H 43/00*** | (2006.01) |
| ***B31B 50/26*** | (2017.01) |
| ***B31F 1/10*** | (2006.01) |

(Continued)

(52) U.S. Cl.

CPC ..... *B65H 45/1015* (2013.01); *B26D 1/1575* (2013.01); *B26D 3/085* (2013.01); *B26D 5/32* (2013.01); *B31B 50/006* (2017.08); *B31B 50/102* (2017.08); *B31B 50/146* (2017.08); *B31B 50/256* (2017.08); *B31B 50/262* (2017.08); *B31F 1/10* (2013.01); *B65H 43/00* (2013.01); *B65H 2701/11231* (2013.01)

(58) Field of Classification Search

CPC ..... B65B 5/024; B65B 59/00; B65B 2210/04

See application file for complete search history.

(56) References Cited

U.S. PATENT DOCUMENTS

| | | | |
|---|---|---|---|
| 1,809,853 | A | 6/1931 | Knowlton |
| 2,077,428 | A | 4/1937 | Robert |

(Continued)

FOREIGN PATENT DOCUMENTS

| | | |
|---|---|---|
| CN | 2164350 | 5/1994 |
| CN | 1191833 | 9/1998 |

(Continued)

OTHER PUBLICATIONS

U.S. Appl. No. 62/447,714, filed Jan. 18, 2017, Osterhout.

(Continued)

*Primary Examiner* — Eyamindae C Jallow

(74) *Attorney, Agent, or Firm* — Workman Nydegger

(57) ABSTRACT

A converting machine is used to convert sheet material into packaging templates for assembly into boxes or other packaging. The converting machine includes a converting assembly that performs transverse conversion functions and longitudinal conversion functions on the sheet material to create the packaging templates. A fanfold crease sensing mechanism detects the presence and location of fanfold creases in the sheet material. Based on the location of the fanfold creases, the fanfold creases are either cut out of the sheet material, or the sheet material is cut to adjust the position of the fanfold crease in a packaging template.

21 Claims, 5 Drawing Sheets

(51) Int. Cl.

| | |
|---|---|
| ***B26D 1/157*** | (2006.01) |
| ***B31B 50/00*** | (2017.01) |
| ***B26D 5/32*** | (2006.01) |
| ***B26D 3/08*** | (2006.01) |
| ***B31B 50/14*** | (2017.01) |
| ***B31B 50/10*** | (2017.01) |
| ***B31B 50/25*** | (2017.01) |

(56) References Cited

U.S. PATENT DOCUMENTS 2,083,351 A 7/1937 Sidebotham
2,181,117 A 11/1939 Brenn
2,256,082 A 9/1941 Feurt
2,449,663 A 9/1948 Marcalus
2,609,736 A 9/1952 Montgomery
2,631,509 A 3/1953 Whytlaw
2,679,195 A 5/1954 Whytlaw
2,699,711 A 1/1955 Mobley
2,798,582 A 7/1957 Monroe
2,904,789 A 9/1959 Radin et al.
3,057,267 A 10/1962 Johnson, Jr.
3,096,692 A 7/1963 Crathern et al.
3,105,419 A 10/1963 La Bombard
3,108,515 A 10/1963 Stohlquist
3,153,991 A 10/1964 Goodrich
3,285,145 A 11/1966 Lieberman
3,303,759 A 2/1967 Burke
3,308,723 A 3/1967 Bergh, Jr.
3,332,207 A 7/1967 Midnight
3,406,611 A 10/1968 Benjamin et al.
3,418,893 A 12/1968 Stohlquist
3,469,508 A 9/1969 Klapp
3,511,496 A 5/1970 Zoglmann
3,543,469 A 12/1970 Ullman
3,555,776 A 1/1971 Nigrelli et al.
3,566,755 A 3/1971 Smith et al.
3,611,884 A 10/1971 Hottendorf
3,618,479 A 11/1971 Shields
3,628,408 A 12/1971 Rod et al.
3,646,418 A 2/1972 Sterns et al.
3,743,154 A 7/1973 Brewitz
3,763,750 A 10/1973 Reichert
3,776,109 A 12/1973 Clark et al.
3,803,798 A 4/1974 Clancy
3,804,514 A * 4/1974 Jasinski ..... G03B 27/6264 355/75
3,807,726 A 4/1974 Hope
3,866,391 A 2/1975 Puskarz et al.
3,882,764 A 5/1975 Johnson
3,886,833 A 6/1975 Gunn et al.
3,891,203 A 6/1975 Schiff
3,912,389 A 10/1975 Miyamoto
3,913,464 A 10/1975 Flaum
3,949,654 A 4/1976 Stehlin
3,986,319 A 10/1976 Puskarz et al.
4,033,217 A 7/1977 Flaum et al.
4,044,658 A 8/1977 Mitchard
4,052,048 A 10/1977 Shirasaka
4,056,025 A 11/1977 Rubel
4,094,451 A 6/1978 Wescoat
4,121,506 A 10/1978 Van Grouw
4,123,966 A 11/1978 Buschor
4,164,171 A 8/1979 Meyers et al.
4,173,106 A 11/1979 Garcia et al.
4,184,770 A 1/1980 Pinior
4,191,467 A 3/1980 Schieck
4,221,373 A 9/1980 Mueller
4,224,847 A 9/1980 Tokuno
4,252,233 A 2/1981 Joice
4,261,239 A 4/1981 Toboshi et al.
4,264,200 A 4/1981 Tickner
4,295,841 A 10/1981 Ward, Jr.
4,320,960 A * 3/1982 Ward ..... B65H 43/00 355/75
4,342,562 A 8/1982 Froeidh et al.
4,368,052 A 1/1983 Bitsky et al.
4,373,412 A 2/1983 Gerber et al.
4,375,970 A 3/1983 Murphy
4,401,250 A 8/1983 Carlsson
4,449,349 A 5/1984 Roth
4,487,596 A 12/1984 Livens et al.
4,563,169 A 1/1986 Virta et al.
4,578,054 A 3/1986 Herrin
D286,044 S 10/1986 Kando
4,638,696 A 1/1987 Urwyler
4,684,360 A 8/1987 Tokuno et al.
4,695,006 A 9/1987 Pool
4,714,946 A 12/1987 Bajgert
4,743,131 A 5/1988 Atwell
4,749,295 A 6/1988 Bankier
4,773,781 A 9/1988 Bankier
4,838,468 A 6/1989 Lesse
4,844,316 A 7/1989 Keeny
4,847,632 A 7/1989 Norris
4,878,521 A 11/1989 Fredrickson
4,887,412 A 12/1989 Takamura
4,923,188 A 5/1990 Neir
4,932,930 A 6/1990 Coalier et al.
4,979,932 A 12/1990 Burnside
4,994,008 A 2/1991 Haake et al.
5,005,816 A 4/1991 Stemmler
5,030,192 A * 7/1991 Sager ..... B65H 45/107 493/414
5,039,242 A 8/1991 Johnson
5,046,716 A 9/1991 Lippold
5,058,872 A 10/1991 Gladow
5,072,641 A 12/1991 Urban et al.
5,074,836 A * 12/1991 Fechner ..... B65H 45/1015 493/411
5,081,487 A 1/1992 Hoyer
5,090,281 A 2/1992 Paulson
5,094,660 A 3/1992 Okuzawa
5,106,359 A 4/1992 Lott
5,111,252 A 5/1992 Hamada
5,118,093 A 6/1992 Makiura
5,120,279 A 6/1992 Adami
5,120,297 A 6/1992 Adami
5,123,890 A 6/1992 Green
5,123,894 A 6/1992 Bergeman
5,137,172 A 8/1992 Wagner
5,137,174 A 8/1992 Bell
5,148,654 A 9/1992 Kisters
5,154,041 A 10/1992 Schneider
5,157,903 A * 10/1992 Nakashima ..... B65B 11/54 493/476
5,197,366 A 3/1993 Paulson
5,240,243 A 8/1993 Gompertz
5,241,353 A 8/1993 Maeshima
5,259,255 A 11/1993 Urban et al.
5,263,785 A 11/1993 Negoro
D344,751 S 3/1994 Keong
5,321,464 A 6/1994 Jessen
2,353,419 A 7/1994 Smithson
5,335,777 A 8/1994 Murphy
5,358,345 A 10/1994 Damitio
5,369,939 A 12/1994 Moen et al.
5,375,390 A 12/1994 Frigo et al.
5,397,423 A 3/1995 Bantz et al.
5,411,252 A 5/1995 Lowell
5,584,633 A 12/1996 Scharer
5,586,758 A 12/1996 Kimura
5,624,369 A 4/1997 Bidlack et al.
5,667,468 A 9/1997 Bandura
5,671,593 A 9/1997 Ginestra et al.
5,716,313 A 2/1998 Sigrist et al.
5,727,725 A 3/1998 Paskvich
5,767,975 A 6/1998 Ahlen
5,836,498 A 11/1998 Turek
5,902,223 A 5/1999 Simmons
5,927,702 A 7/1999 Ishii
5,941,451 A 8/1999 Dexter
5,964,686 A 12/1999 Bidlack et al.
6,000,525 A 12/1999 Frulio

(56) References Cited

U.S. PATENT DOCUMENTS 6,071,223 A * 6/2000 Reider ..... B65H 45/1015 493/11
6,113,525 A 9/2000 Waechter
6,164,045 A 12/2000 Focke
6,189,933 B1 2/2001 Felderman
6,245,004 B1 6/2001 Waters
6,321,650 B1 11/2001 Ogawa
6,397,557 B1 6/2002 Bassissi
6,428,000 B1 8/2002 Hara
6,471,154 B1 10/2002 Zsolt
6,553,207 B2 4/2003 Tsusaka
6,568,865 B1 5/2003 Fujioka
6,673,001 B2 1/2004 Toth
6,690,476 B1 * 2/2004 Hren ..... B41J 13/106 271/117
6,830,328 B2 12/2004 Cuyler, Jr.
6,837,135 B2 1/2005 Michalski
6,840,898 B2 1/2005 Pettersson
6,910,997 B1 6/2005 Yampolsky et al.
6,968,859 B1 11/2005 Nagano et al.
7,060,016 B2 6/2006 Cipolli
7,100,811 B2 9/2006 Pettersson
7,115,086 B1 10/2006 Campbell, Jr.
7,121,543 B2 10/2006 Fujioka
7,201,089 B2 4/2007 Richter
7,237,969 B2 7/2007 Bartman
7,537,557 B2 5/2009 Holler
7,637,857 B2 * 12/2009 Coullery ..... B31B 50/00 493/13
7,641,190 B2 1/2010 Hara
7,647,752 B2 1/2010 Magnell
7,648,451 B2 1/2010 Calugi
7,648,596 B2 1/2010 Sharpe et al.
7,690,099 B2 4/2010 Bapst et al.
7,735,299 B2 6/2010 Cash, III
7,739,856 B2 6/2010 Cash, III
7,997,578 B2 8/2011 Saito
D703,246 S 4/2014 Pettersson et al.
8,999,108 B2 4/2015 Nagao et al.
9,069,151 B2 6/2015 Conner
9,120,284 B2 9/2015 Capoia
9,199,794 B2 12/2015 Nadachi et al.
9,329,565 B2 5/2016 Osaki
9,352,526 B2 5/2016 Pettersson et al.
9,434,496 B2 9/2016 Systema
9,924,502 B2 3/2018 Choi et al.
9,969,142 B2 5/2018 Pettersson et al.
10,093,438 B2 10/2018 Pettersson
10,155,352 B2 12/2018 Sytema et al.
10,286,621 B2 5/2019 Toro
10,583,943 B2 3/2020 Feijen et al.
10,836,516 B2 11/2020 Pettersson
10,836,517 B2 11/2020 Ponti
2002/0017754 A1 2/2002 Kang
2002/0066683 A1 6/2002 Sanders
2002/0091050 A1 7/2002 Bacciottini
2002/0115548 A1 8/2002 Lin et al.
2002/0125712 A1 9/2002 Felderman
2002/0139890 A1 10/2002 Toth
2003/0102244 A1 6/2003 Sanders
2003/0217628 A1 11/2003 Michalski
2004/0060264 A1 4/2004 Miller
2004/0082453 A1 4/2004 Pettersson
2004/0092374 A1 5/2004 Chiu-Fu
2004/0144555 A1 7/2004 Buekers et al.
2004/0173068 A1 9/2004 Adachi
2004/0198577 A1 10/2004 Blumle
2004/0214703 A1 10/2004 Berens et al.
2004/0261365 A1 12/2004 White
2005/0079965 A1 4/2005 Moshier et al.
2005/0103923 A1 * 5/2005 Pettersson ..... B65H 20/00 242/615.2
2005/0215409 A1 9/2005 Abramson et al.
2005/0280202 A1 12/2005 Vila
2006/0178248 A1 8/2006 Coullery et al.
2006/0180438 A1 8/2006 Mosli et al.
2006/0180991 A1 8/2006 Nakahata et al.
2006/0181008 A1 8/2006 Van Gerven
2007/0079575 A1 4/2007 Monti
2007/0227927 A1 10/2007 Coltri-Johnson
2007/0228119 A1 10/2007 Barner
2007/0287623 A1 12/2007 Carlson
2007/0289253 A1 12/2007 Miller
2008/0020916 A1 * 1/2008 Magnell ..... B65B 5/02 493/65
2008/0037273 A1 2/2008 Muehlemann et al.
2008/0066632 A1 3/2008 Raueiser
2008/0115641 A1 5/2008 Freyburger et al.
2008/0148917 A1 6/2008 Pettersson
2008/0300120 A1 12/2008 Sato
2009/0062098 A1 3/2009 Inoue et al.
2009/0178528 A1 7/2009 Adami
2009/0199527 A1 8/2009 Wehr et al.
2010/0041534 A1 * 2/2010 Harding ..... B31D 5/0047 493/464
2010/0111584 A1 5/2010 Shiohara
2010/0206582 A1 8/2010 Meyyappan et al.
2010/0210439 A1 8/2010 Goto
2011/0026999 A1 2/2011 Kohira
2011/0053746 A1 3/2011 Desertot et al.
2011/0092351 A1 4/2011 Hatano
2011/0099782 A1 5/2011 Schonberger
2011/0110749 A1 5/2011 Carter et al.
2011/0171002 A1 7/2011 Pettersson
2011/0229191 A1 9/2011 Nomi
2011/0230325 A1 9/2011 Harding et al.
2011/0319242 A1 9/2011 Pettersson
2011/0283855 A1 11/2011 Kwarta et al.
2012/0021884 A1 1/2012 Musha
2012/0106963 A1 5/2012 Huang et al.
2012/0122640 A1 5/2012 Pazdernik et al.
2012/0129670 A1 5/2012 Pettersson et al.
2012/0139670 A1 6/2012 Yamagata
2012/0142512 A1 6/2012 Keller
2012/0242512 A1 9/2012 Horstemeyer
2012/0319920 A1 12/2012 Athley et al.
2012/0328253 A1 12/2012 Hurley et al.
2013/0000252 A1 1/2013 Pettersson et al.
2013/0045847 A1 2/2013 Capoia
2013/0104718 A1 5/2013 Tai
2013/0108227 A1 5/2013 Conner
2013/0130877 A1 5/2013 Su
2013/0146355 A1 6/2013 Strasser et al.
2013/0210597 A1 8/2013 Pettersson
2013/0294735 A1 11/2013 Burris et al.
2013/0333538 A1 12/2013 Long et al.
2014/0078635 A1 3/2014 Conner et al.
2014/0091511 A1 3/2014 Martin
2014/0101929 A1 * 4/2014 Kim ..... H01M 2/1061 29/623.1
2014/0140671 A1 5/2014 Islam
2014/0315701 A1 10/2014 Pettersson
2014/0336026 A1 11/2014 Pettersson
2014/0357463 A1 * 12/2014 Kojima ..... B31F 1/0012 493/442
2015/0018189 A1 * 1/2015 Pettersson ..... B26D 9/00 493/370
2015/0019387 A1 * 1/2015 Pettersson ..... G06Q 30/0635 705/26.81
2015/0053349 A1 2/2015 Mori et al.
2015/0055926 A1 2/2015 Strasser et al.
2015/0103923 A1 4/2015 Ramasubramonian et al.
2015/0148210 A1 * 5/2015 Sibthorpe ..... B41J 3/407 493/324
2015/0155697 A1 6/2015 Loveless et al.
2015/0224731 A1 8/2015 Ponti
2015/0273897 A1 10/2015 Kato
2015/0355429 A1 12/2015 Villegas et al.
2015/0360433 A1 12/2015 Feijen et al.
2015/0360801 A1 12/2015 Sytema
2016/0001441 A1 1/2016 Osterhout et al.
2016/0049782 A1 2/2016 Strasser et al.
2016/0122044 A1 5/2016 Evers
2016/0184142 A1 6/2016 Vanvalkenburgh et al.

(56) References Cited

U.S. PATENT DOCUMENTS

| | | | |
|---|---|---|---|
| 2016/0185065 | A1 | 6/2016 | Sytema et al. |
| 2016/0185475 | A1* | 6/2016 | Pettersson ..... B65B 59/02 53/493 |
| 2016/0241468 | A1 | 8/2016 | Sabella et al. |
| 2016/0340067 | A1 | 11/2016 | Winkler et al. |
| 2017/0190134 | A1 | 7/2017 | Van et al. |
| 2017/0355166 | A1 | 12/2017 | Jonker |
| 2017/0361560 | A1 | 12/2017 | Osterhout |
| 2018/0178476 | A1 | 6/2018 | Pettersson et al. |
| 2018/0201465 | A1 | 7/2018 | Osterhout |
| 2018/0265228 | A1* | 9/2018 | Hagestedt ..... B65B 23/00 |
| 2019/0002137 | A1 | 1/2019 | Pettersson |
| 2019/0184670 | A1 | 6/2019 | Davies et al. |
| 2019/0308383 | A1 | 10/2019 | Provoost et al. |
| 2019/0308761 | A1 | 10/2019 | Provoost et al. |
| 2019/0329513 | A1 | 10/2019 | Pettersson |
| 2019/0389611 | A1 | 12/2019 | Pettersson |
| 2020/0031506 | A1 | 1/2020 | Ponti |
| 2020/0101686 | A1 | 4/2020 | Fredander et al. |
| 2020/0407087 | A1 | 12/2020 | Pettersson |
| 2021/0001583 | A1 | 1/2021 | Osterhout |
| 2021/0039347 | A1 | 2/2021 | Pettersson et al. |
| 2021/0261281 | A1 | 8/2021 | Engleman et al. |
| 2021/0370633 | A1 | 12/2021 | Provoost et al. |
| 2021/0371229 | A1 | 12/2021 | Osterhout |

FOREIGN PATENT DOCUMENTS

| | | | |
|---|---|---|---|
| CN | 1366487 | | 8/2002 |
| CN | 1449966 | A | 10/2003 |
| CN | 1876361 | | 12/2006 |
| CN | 2925862 | Y | 7/2007 |
| CN | 201941185 | U | 8/2011 |
| CN | 201990294 | U | 9/2011 |
| CN | 102371705 | | 3/2012 |
| CN | 202412794 | | 9/2012 |
| CN | 102753442 | | 10/2012 |
| CN | 102791581 | A | 11/2012 |
| CN | 104169073 | | 11/2014 |
| CN | 104185538 | | 12/2014 |
| CN | 102941592 | | 4/2015 |
| CN | 104812560 | A | 7/2015 |
| CN | 104890208 | A | 9/2015 |
| CN | 104985868 | A | 10/2015 |
| CN | 204773785 | | 11/2015 |
| CN | 106079570 | A | 11/2016 |
| CN | 107614253 | A | 1/2018 |
| DE | 1082227 | | 5/1960 |
| DE | 1212854 | | 3/1966 |
| DE | 2700004 | A1 | 7/1978 |
| DE | 2819000 | A1 | 11/1978 |
| DE | 3343523 | A1 | 6/1985 |
| DE | 3825506 | A1 | 2/1990 |
| DE | 19541061 | | 11/1996 |
| DE | 10355544 | | 6/2005 |
| DE | 102005063193 | | 7/2007 |
| DE | 102008035278 | | 4/2010 |
| EP | 30366 | | 6/1981 |
| EP | 0234228 | A2 | 9/1987 |
| EP | 359005 | | 3/1990 |
| EP | 650827 | | 5/1995 |
| EP | 889779 | | 1/1999 |
| EP | 903219 | | 3/1999 |
| EP | 1065162 | | 1/2001 |
| EP | 1223107 | | 7/2002 |
| EP | 1373112 | | 1/2004 |
| EP | 1428759 | A2 | 6/2004 |
| EP | 1997736 | | 12/2008 |
| EP | 1497049 | | 3/2010 |
| EP | 2228206 | | 9/2010 |
| EP | 2377764 | A1 | 10/2011 |
| EP | 3231594 | A1 | 10/2017 |
| FR | 428967 | | 9/1911 |
| FR | 1020458 | | 2/1953 |
| FR | 1592372 | | 5/1970 |
| FR | 2280484 | A1 | 2/1976 |
| FR | 2626642 | A1 | 8/1989 |
| FR | 2721301 | | 12/1995 |
| FR | 2770445 | | 5/1999 |
| FR | 2808722 | | 11/2001 |
| FR | 2814393 | A1 | 3/2002 |
| FR | 2976561 | | 12/2012 |
| GB | 0166622 | | 7/1921 |
| GB | 983946 | | 2/1965 |
| GB | 1362060 | | 7/1974 |
| GB | 1546789 | A | 5/1979 |
| JP | 49-099239 | A | 9/1974 |
| JP | 50-078616 | A | 6/1975 |
| JP | 51-027619 | A | 3/1976 |
| JP | S5557984 | | 4/1980 |
| JP | S5689937 | | 7/1981 |
| JP | S59176836 | | 10/1984 |
| JP | 59-198243 | A | 11/1984 |
| JP | S61118720 | | 7/1986 |
| JP | 62-172032 | | 10/1987 |
| JP | 01-133164 | A | 5/1989 |
| JP | 03-070927 | A | 3/1991 |
| JP | 3089399 | | 9/1991 |
| JP | 06-123606 | A | 5/1994 |
| JP | 07-156305 | A | 6/1995 |
| JP | H08238690 | | 9/1996 |
| JP | H08333036 | | 12/1996 |
| JP | 2000323324 | | 11/2000 |
| JP | 2003079446 | | 3/2003 |
| JP | 2003-112849 | A | 4/2003 |
| JP | 2003-194516 | A | 7/2003 |
| JP | 2004-330351 | A | 11/2004 |
| JP | 2005067019 | | 3/2005 |
| JP | 2005219798 | | 8/2005 |
| JP | 2006289914 | | 10/2006 |
| JP | 2008254789 | | 10/2008 |
| JP | 2009-023074 | | 2/2009 |
| JP | 2009132049 | | 6/2009 |
| JP | 2010-012628 | A | 1/2010 |
| JP | 2011520674 | | 7/2011 |
| JP | 2011230385 | | 11/2011 |
| JP | 2015-502273 | A | 1/2015 |
| JP | 2016-074133 | A | 5/2016 |
| RU | 2015030 | | 6/1994 |
| RU | 2004136918 | | 5/2006 |
| RU | 2334668 | C2 | 9/2008 |
| RU | 2345893 | C2 | 2/2009 |
| RU | 2398674 | | 9/2010 |
| RU | 2014123534 | A | 12/2015 |
| RU | 2014123562 | A | 12/2015 |
| SE | 450829 | | 8/1987 |
| SE | 515630 | C2 | 9/2001 |
| SU | 40025 | A1 | 12/1934 |
| SU | 992220 | A1 | 1/1983 |
| SU | 1054863 | | 11/1983 |
| SU | 1121156 | A1 | 10/1984 |
| SU | 1676825 | A1 | 9/1991 |
| SU | 1718783 | | 3/1992 |
| SU | 1756211 | A1 | 8/1992 |
| WO | 199614773 | | 6/1996 |
| WO | WO 1999/017923 | | 4/1999 |
| WO | 00/21713 | A1 | 4/2000 |
| WO | 01/04017 | A1 | 1/2001 |
| WO | 01/85408 | A2 | 11/2001 |
| WO | 2003089163 | | 10/2003 |
| WO | 03/97340 | | 11/2003 |
| WO | 2009/093936 | A1 | 7/2009 |
| WO | 2010091043 | | 8/2010 |
| WO | 2011007237 | | 1/2011 |
| WO | 2011100078 | | 8/2011 |
| WO | 2011135433 | | 11/2011 |
| WO | 2012003167 | | 1/2012 |
| WO | 2013071073 | | 5/2013 |
| WO | 2013071080 | | 7/2013 |
| WO | 2013106180 | | 7/2013 |
| WO | 2013114057 | | 8/2013 |
| WO | 2014/048934 | A1 | 4/2014 |
| WO | 2014/117816 | | 8/2014 |

(56) References Cited

FOREIGN PATENT DOCUMENTS

| | | | |
|---|---|---|---|
| WO | 2014/117817 | A1 | 8/2014 |
| WO | 2015/173745 | A1 | 11/2015 |
| WO | WO 2016/176271 | | 11/2016 |
| WO | 2017/203399 | A1 | 11/2017 |
| WO | 2017203401 | | 11/2017 |
| WO | 2017218296 | | 12/2017 |
| WO | 2017218297 | | 12/2017 |

OTHER PUBLICATIONS

International Search Report and Written Opinion for PCT/US18/14275 dated Apr. 4, 2018.
Final Office Action received for U.S. Appl. No. 13/147,787, dated Feb. 16, 2016.
Final Office Action received for U.S. Appl. No. 13/147,787, dated Mar. 7, 2017.
Final Office Action received for U.S. Appl. No. 14/357,183, dated Nov. 12, 2015.
Final Office Action received for U.S. Appl. No. 14/357,190, dated Aug. 1, 2017.
Final Office Action received for U.S. Appl. No. 14/370,729 dated Jul. 12, 2017.
International Search Report and Wirtten Opinion for application No. PCT/US2012/070719 dated Feb. 25, 2013.
International Search Report and Written Opininon for application No. PCT/US2017/036606 dated Oct. 24, 2017.
International Search Report and Written Opinion for application No. PCT/US2017/036603 dated Oct. 27, 2017.
International Search Report and Written Opinion received for PCT Patent Application No. PCT/US2019/049535, dated Jun. 9, 2020, 14 pages.
International Search Report and Written Opinion received for PCT Patent Application No. PCT/US2020/012519, dated Jun. 26, 2020, 20 pages.
International Search Report and Written Opinion, PCT/US2012/064403, US Search Authority, Completed Mar. 26, 2013, dated Apr. 8, 2013.
International Search Report and Written Opinion, PCT/US2012/064414, US Search Authority, Completed Jan. 4, 2013, dated Jan. 25, 2013.
Office Action received for U.S. Appl. No. 13/147,787, dated Aug. 27, 2014.
Office Action received for U.S. Appl. No. 13/147,787, dated Oct. 28, 2016.
Office Action received for U.S. Appl. No. 13/805,602, dated Dec. 2, 2015.
Office Action received for U.S. Appl. No. 14/357,183, dated Jul. 16, 2015.
Office Action received for U.S. Appl. No. 14/357,190, dated Feb. 17, 2017.
Office Action received for U.S. Appl. No. 29/419,922, dated Aug. 6, 2013.
Office Action received for U.S. Appl. No. 14/370,729, dated Dec. 15, 2017.
Office Action received for U.S. Appl. No. 14/370,729 dated Jan. 26, 2017.
Office Action received for U.S. Appl. No. 15/872,770 dated Mar. 27, 2020.
U.S. Appl. No. 16/310,406, filed Dec. 14, 2018, Pettersson et al.
European Search Report for EP80107577.1 dated Mar. 2, 1981.
European Search Report for EP89115688.7 dated Nov. 2, 1989.
International Search Report and Written Opinion for application No. PCT/US2010/022983 dated Apr. 13, 2010.
International Search Report for PCT/US2011/042096 dated Oct. 28, 2011.
International Search Report and Written Opinion for PCT/US2012/064414 dated Jan. 25, 2013.
European Search Report for EP10739040 dated Jan. 31, 2013.
International Search Report and Written Opinion for PCT/US2012/064403 dated Apr. 8, 2013.
European Search Report for EP12848321 dated Jul. 1, 2015.
European Search Report for EP12865028 dated Jul. 7, 2015.
International Search Report and Written Opinion for PCT/US2015/67375 dated Mar. 11, 2016.
European Search Report for EP16169030 dated Dec. 16, 2016, dated Jan. 5, 2017.
European Search Report for application No. EP17175751 dated Aug. 25, 2017.
Japanese Office Action for application No. 2017-000038 dated Sep. 22, 2017.
International Search Report and Written Opinion for application No. PCT/US2017/036603 dated Oct. 18, 2017.
International Search Report and Written Opinion for PCT/US2018/020928 dated Jun. 7, 2018.
International Search Report and Written Opinion PCT/IB2019/052794 dated Jun. 19, 2019.
International Search Report and Written Opinion for PCT/US2019/038142 dated Aug. 2, 2019.
International Search Report and Written Opinion PCT/IB2019/052793 dated Nov. 11, 2019.
International Search Report and Written Opinion for PCT/US2019/049102 dated Dec. 2, 2019.
International Search Report and Written Opinion for PCT/US19/62696 dated Feb. 4, 2020.
U.S. Appl. No. 13/147,787, Aug. 27, 2014, Office Action.
U.S. Appl. No. 13/147,787, Apr. 17, 2015, Final Office Action.
U.S. Appl. No. 13/147,787, Sep. 30, 2015, Office Action.
U.S. Appl. No. 13/147,787, Feb. 16, 2016, Final Office Action.
U.S. Appl. No. 13/147,787, Oct. 28, 2016, Office Action.
U.S. Appl. No. 13/147,787, Mar. 7, 2017, Final Office Action.
U.S. Appl. No. 13/147,787, Jun. 26, 2017, Notice of Allowance.
U.S. Appl. No. 13/805,602, Dec. 2, 2015, Office Action.
U.S. Appl. No. 13/805,602, Mar. 21, 2016, Notice of Allowance.
U.S. Appl. No. 14/357,183, Jul. 16, 2015, Office Action.
U.S. Appl. No. 14/357,183, Nov. 12, 2015, Final Office Action.
U.S. Appl. No. 14/357,183, Jan. 29, 2016, Notice of Allowance.
U.S. Appl. No. 14/370,729, Jan. 26, 2017, Office Action.
U.S. Appl. No. 14/370,729, Jul. 12, 2017, Final Office Action.
U.S. Appl. No. 14/370,729, Dec. 19, 2017, Office Action.
U.S. Appl. No. 14/370,729, May 21, 2018, Notice of Allowance.
U.S. Appl. No. 14/357,190, Feb. 17, 2017, Office Action.
U.S. Appl. No. 14/357,190, Aug. 1, 2017, Final Office Action.
U.S. Appl. No. 14/357,190, Dec. 5, 2017, Notice of Allowance.
U.S. Appl. No. 14/357,190, Jan. 12, 2018, Notice of Allowance.
U.S. Appl. No. 29/419,922, Aug. 6, 2013, Office Action.
U.S. Appl. No. 29/419,922, Nov. 29, 2013, Notice of Allowance.
U.S. Appl. No. 15/901,089, Apr. 13, 2020, Office Action.
U.S. Appl. No. 14/970,224, May 30, 2018, Office Action.
U.S. Appl. No. 14/970,224, Aug. 13, 2018, Notice of Allowance.
U.S. Appl. No. 16/109,261, Apr. 28, 2020, Office Action.
U.S. Appl. No. 15/616,688, Mar. 19, 2020, Office Action.
International Preliminary Report on Patentability received for PCT Patent Application No. PCT/US2019/038142, dated Dec. 30, 2020, 8 pages.
International Search Report and Written Opinion for corresponding PCT Application No. PCT/IB2015/054179, dated Aug. 28, 2015, 13 pages.
U.S. Appl. No. 16/435,252, filed Jun. 7, 2019.
Non-Final Office Action received for U.S. Appl. No. 16/375,579, dated Feb. 18, 2021, 12 pages.
Non-Final Office Action received for U.S. Appl. No. 16/310,406, dated Aug. 19, 2020, 22 pages.
Non-Final Office Action received for U.S. Appl. No. 16/375,588, dated Jul. 2, 2021, 15 pages.
Non-Final Office Action received for U.S. Appl. No. 16/619,818, dated Aug. 31, 2021, 13 pages.

* cited by examiner

CONVERTING MACHINE WITH FOLD SENSING MECHANISM

The present application claims priority to and the benefit of U.S. Provisional Application No. 62/447,714, filed Jan. 18, 2017, and entitled Converting Machine With Fold Sensing Mechanism, the entire content of which is incorporated herein by reference.

BACKGROUND

1. Technical Field

Exemplary embodiments of the disclosure relate to systems, methods, and devices for converting sheet materials. More specifically, exemplary embodiments relate to a converting machine for converting paperboard, corrugated board, cardboard, and similar sheet materials into templates for boxes and other packaging.

2. The Relevant Technology

Shipping and packaging industries frequently use paperboard and other sheet material processing equipment that converts sheet materials into box templates. One advantage of such equipment is that a shipper may prepare boxes of required sizes as needed in lieu of keeping on hand a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 65% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Customized sized boxes also reduce the shipping costs associated with shipping items compared to shipping the items in oversized boxes. A shipping vehicle filled with boxes that are 65% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship the same number of items. Accordingly, in addition or as an alternative to calculating shipping prices based on the weight of a package, shipping prices are often affected by the size of the shipped package. Thus, reducing the size of an item's package can reduce the price of shipping the item. Even when shipping prices are not calculated based on the size of the packages (e.g., only on the weight of the packages), using custom sized packages can reduce the shipping costs because the smaller, custom sized packages will weigh less than oversized packages due to using less packaging and filling material.

Although sheet material processing machines and related equipment can potentially alleviate the inconveniences associated with stocking standard sized shipping supplies and reduce the amount of space required for storing such shipping supplies, previously available machines and associated equipment have various drawbacks. Some of the drawbacks result from using fanfold sheet material to create box or packaging templates. Fanfold sheet material is sheet material (e.g., paperboard, corrugated board, cardboard) that has been folded back and forth on itself such that the material is stacked into layers. A crease or fold (also referred to herein as a "fanfold crease") is formed in the material between each layer to allow the material to be stacked in layers. When the material is unfolded so that it can be converted into box templates or other packaging, the fanfold creases may pose some difficulties in forming the box templates or packaging. For instance, the fanfold creases may cause the sheet material to fold or otherwise not lie flat, which can cause the sheet material to jam a converting machine that is being used to convert the sheet material to a box template or other packaging.

The fanfold creases may also pose some challenges to forming the box templates into strong, structurally sound boxes. For instance, if a box template is formed with a fanfold crease extending through a glue tab of the box template (or a portion of the template to which the glue tab is to be glued), the fanfold crease may cause the glue tab to curl or fold, making it difficult to securely attach the glue tab to another portion of the box template. Similarly, fanfold creases in other areas of a box template (e.g., in the flaps, panels, etc.) can also make it more difficult to erect a box from the box template or make the erected box less structurally sound.

Accordingly, there remains room for improvement in the area of sheet material processing machines.

BRIEF SUMMARY

Exemplary embodiments of the disclosure relate to systems, methods, and devices for converting sheet materials into boxes. More specifically, exemplary embodiments relate to box forming machines that convert paperboard, corrugated board, cardboard, and similar sheet materials into box templates and fold and glue the box templates to form un-erected boxes.

For instance, one embodiment is directed to a converting machine used to convert sheet material into packaging templates for assembly into boxes or other packaging. The converting machine includes a converting assembly configured to perform one or more transverse conversion functions and one or more longitudinal conversion functions on the sheet material as the sheet material moves through the converting machine in a feed direction. The one or more transverse conversion functions and the one or more longitudinal conversion functions may be selected from the group consisting of creasing, bending, folding, perforating, cutting, and scoring, to create the packaging templates. A fanfold crease sensing mechanism is configured to detect the presence and location of fanfold creases in the sheet material.

The fanfold crease sensing mechanism includes a first sensor and a second sensor that are offset from one another in the feed direction. Additionally or alternatively, a first sensor is positioned above the sheet material and a second sensor is positioned below the sheet material.

According to another embodiment, a method of converting sheet material into packaging templates for assembly into boxes or other packaging is provided. The method includes detecting with a plurality of offset sensors the presence and location of a fanfold crease in the sheet material. A determination is made that the fanfold crease is within a predetermined or user configurable distance of a leading edge of the sheet material. A predetermined or user configurable length is cut off from a leading end of the sheet material to remove the fanfold crease and one or more conversion functions are performed on the remaining sheet material to form the packaging template.

In still another embodiment, a method of converting sheet material into packaging templates for assembly into boxes or other packaging includes detecting with a plurality of offset sensors the presence and location of a fanfold crease in the sheet material and predicting the location of a subsequent fanfold crease in the sheet material. The method also includes determining that the subsequent fanfold crease would be within a predetermined distance of a trailing edge of a packaging template formed from the sheet material and cutting off a predetermined length from a leading end of the sheet material to move the subsequent fanfold crease further from the trailing edge than the predetermined distance. One or more conversion functions are also performed on remaining sheet material to form the packaging template.

These and other objects and features of the present disclosure will become more fully apparent from the following description and appended claims, or may be learned by the practice of the disclosure as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

The embodiments described herein generally relate to systems, methods, and devices for processing sheet materials and converting the same into packaging templates. More specifically, the described embodiments relate to a converting machine for converting sheet materials (e.g., paperboard, corrugated board, cardboard) into templates for boxes and other packaging.

While the present disclosure will describe details of embodiments with reference to specific configurations, the descriptions are illustrative and are not to be construed as limiting the scope of the present invention. Various modifications can be made to the illustrated configurations without departing from the spirit and scope of the invention as defined by the claims. For better understanding, like components have been designated by like reference numbers throughout the various accompanying figures.

As used herein, the term "bale" shall refer to a stock of sheet material that is generally rigid in at least one direction, and may be used to make a box or packaging template. For example, the bale may be formed of a continuous sheet of material or a sheet of material of any specific length, such as corrugated cardboard and paperboard sheet materials.

As used herein, the terms "box template" and "packaging template" shall refer to a substantially flat stock of material that can be folded into a box-like shape. A box or packaging template may have notches, cutouts, divides, and/or creases that allow the box or packaging template to be bent and/or folded into a box. Additionally, a box or packaging template may be made of any suitable material, generally known to those skilled in the art. For example, cardboard or corrugated paperboard may be used as the template material. A suitable material also may have any thickness and weight that would permit it to be bent and/or folded into a box-like shape.

As used herein, the term "crease" shall refer to a line along which the sheet material or box template may fold. For example, a crease may be an indentation in the sheet material. In the case of fanfold creases, the indentation may be made by folding the sheet material into layered stacks in a bale. Other creases may be formed in the sheet material to aid in folding portions of the sheet material separated by the crease, with respect to one another, to form a box.

The terms "notch," "cutout," and "cut" are used interchangeably herein and shall refer to a shape created by removing material from the template or by separating portions of the template, such that a divide through the template is created.

Figure 1:
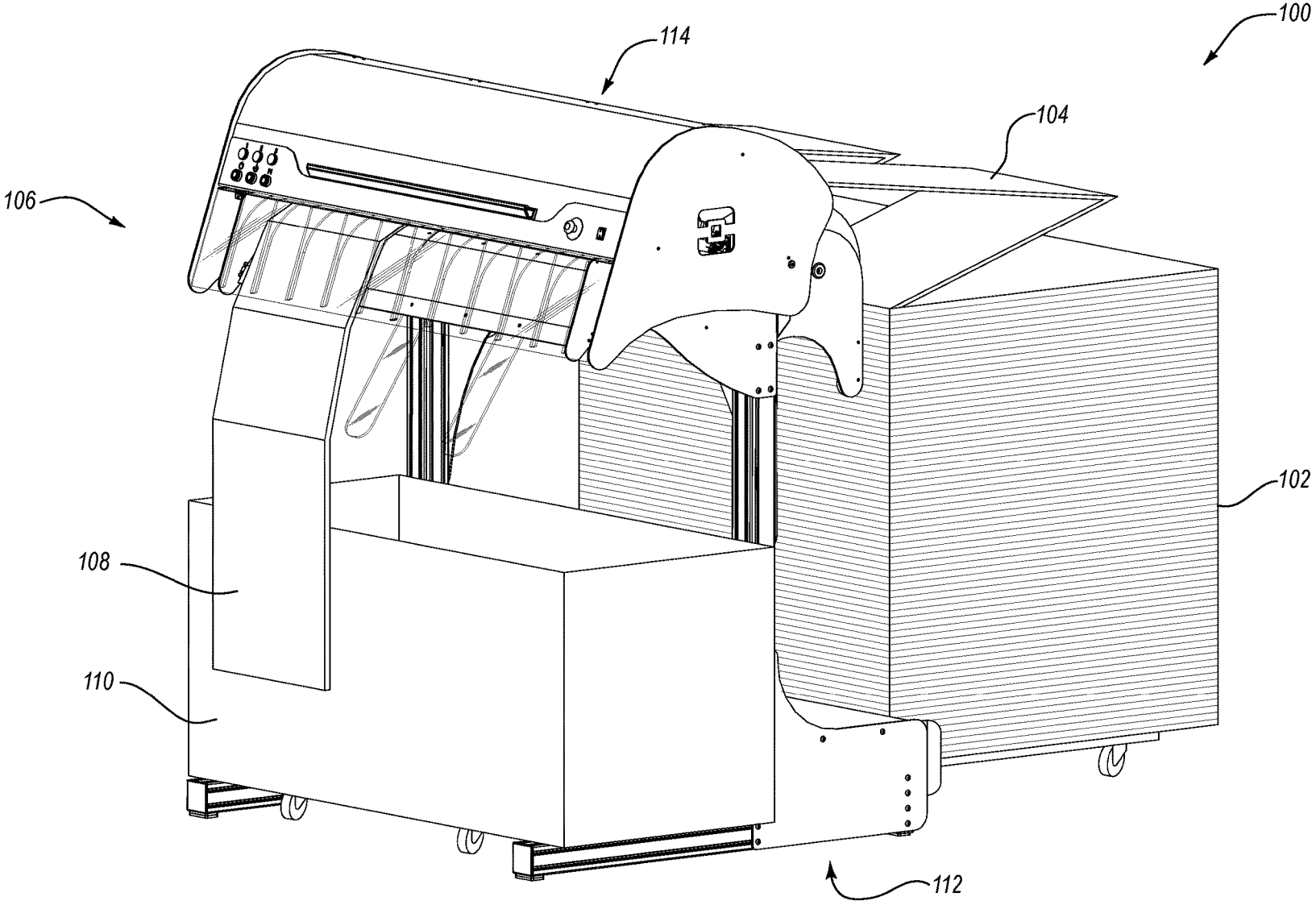
FIG. 1 illustrates a perspective view of an exemplary embodiment of a system for creating packaging templates.

FIG. 1 illustrates a perspective view of a system 100 that may be used to create packaging templates. System 100 includes one or more bales 102 of sheet material 104. System 100 also includes a converting machine 106 that performs one or more conversion functions on sheet material 104, as described in further detail below, in order to create packaging templates 108. Excess or waste sheet material 104 produced during the conversion process may be collected in a collection bin 110. After being produced, packaging templates 108 may be formed into packaging containers, such as boxes.

Figure 2:
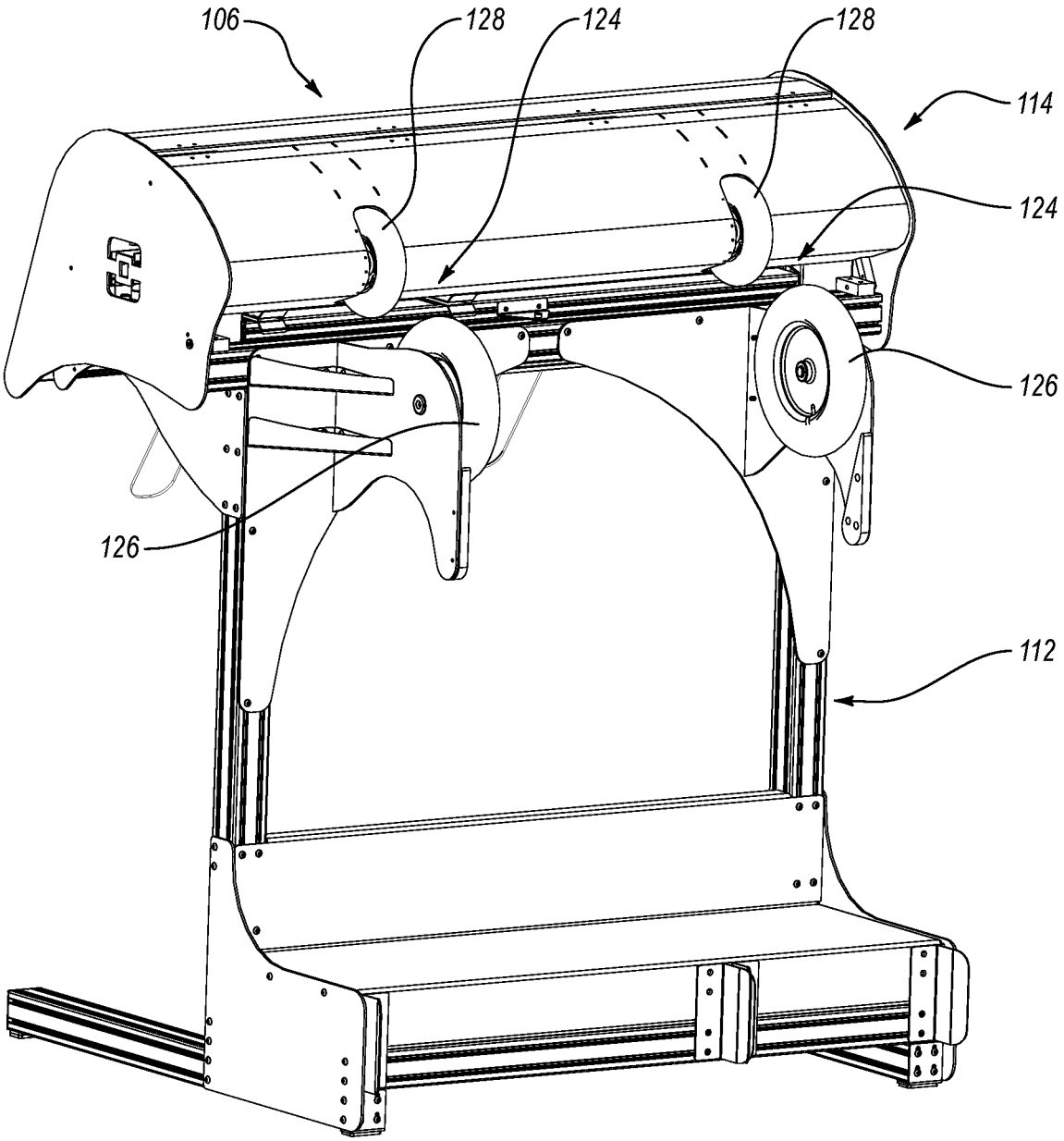
FIG. 2 illustrates a rear perspective view of the converting machine from the system illustrated in FIG. 1.

With continued reference to FIG. 1, attention is also directed to FIG. 2, which generally illustrate various aspects of converting machine 106 is greater detail. As illustrated in FIGS. 1 and 2, converting machine 106 includes a support structure 112 and a converting assembly 114 mounted on support structure 112.

As shown in FIG. 1, bales 102 may be disposed proximate to the backside of converting machine 106, and sheet material 104 may be fed into converting assembly 114. Sheet material 104 may be arranged in bales 102 in multiple stacked layers. The layers of sheet material 104 in each bale 102 may have generally equal lengths and widths and may be folded one on top of the other in alternating directions.

As best seen in FIG. 2, converting machine 106 may also have one or more infeed guides 124. Each infeed guide 124 may include a lower infeed wheel 126 and an upper infeed wheel 128. In some embodiments, lower infeed wheels 126 or upper infeed wheels 128 may be omitted. Each set of lower and upper infeed wheels 126, 128 are designed and arranged to guide sheet material 104 into converting assembly 114 while creating few if any bends, folds, or creases in sheet material 104. For instance, lower and upper infeed wheels 126, 128 may rotate to facilitate smooth movement of sheet material 104 into converting assembly 114. Additionally, lower infeed wheels 126 and/or upper infeed wheels 128 may be at least somewhat deformable so as to limit or prevent the formation of bends, folds, or creases in sheet material 104 as it is fed into converting assembly 114.

As sheet material 104 is fed through converting assembly 114, converting assembly 114 may perform one or more conversion functions (e.g., crease, bend, fold, perforate, cut, score) on sheet material 104 in order to create packaging templates 108. Converting assembly 114 may include therein a converting cartridge that feeds sheet material 104 through converting assembly 114 and performs the conversion functions thereon.

Figure 3:
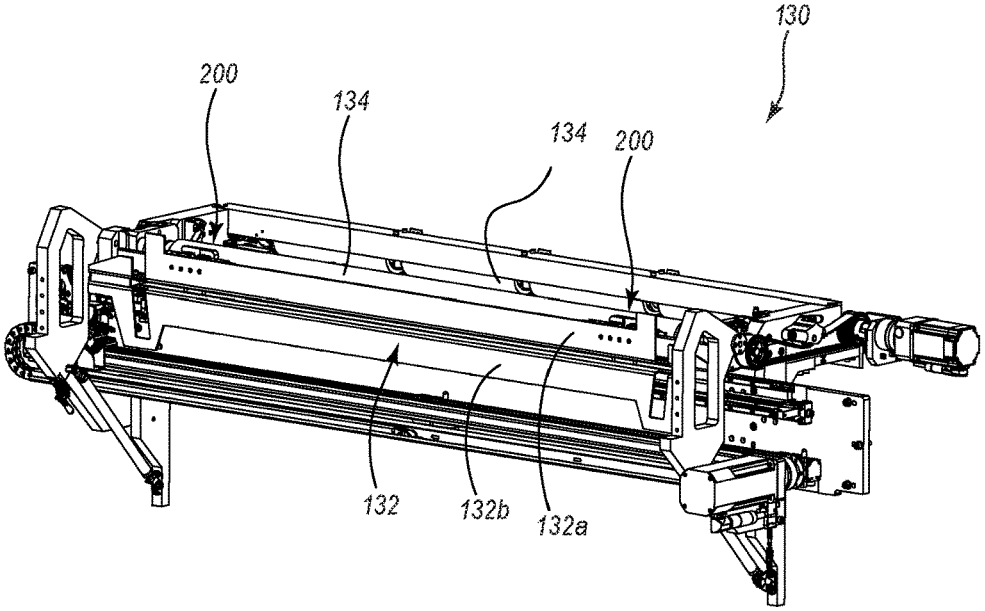
FIG. 3 is a perspective view of a converting cartridge from the converting machine of FIGS. 1 and 2.
Figure 4:
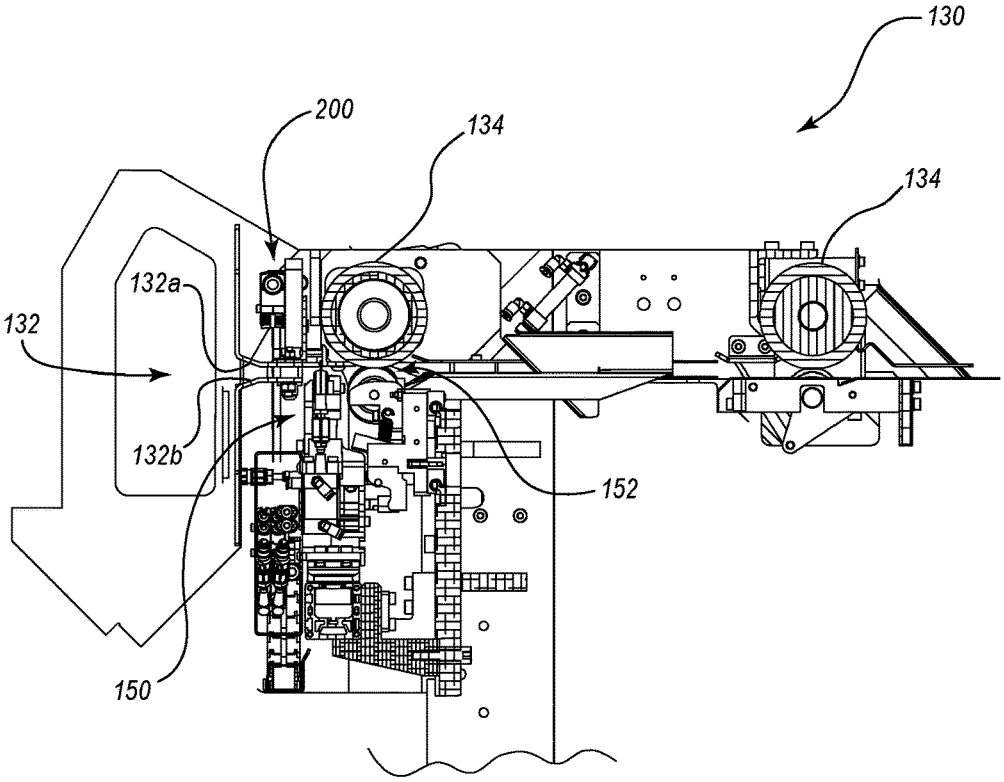
FIG. 4 is a cross-section side view of the converting cartridge of FIG. 3.

FIGS. 3 and 4 illustrate an example converting cartridge 130 separate from the rest of converting assembly 114 and converting machine 106. As can be seen in FIGS. 3 and 4, converting cartridge 130 includes a guide channel 132. Guide channel 132 may be configured to flatten sheet material 104 so as to feed a substantially flat sheet thereof through converting assembly 114. As shown, for instance, guide channel 132 includes opposing upper and lower guide plates 132*a*, 132*b* that are spaced apart sufficiently to allow sheet material 104 to pass therebetween, but also sufficiently close enough together to flatten sheet material 104. In some embodiments, as shown in FIG. 4, the upper and lower guide plates 132*a*, 132*b* may be flared or spaced further apart at on opening end to facilitate insertion of sheet material 104 therebetween.

In the illustrated embodiment, converting cartridge 130 includes a single guide channel 132 that guides lengths of sheet material 104 through converting assembly 114. It will be understood, however, that converting cartridge 130 may include multiple guide channels for feeding one or multiple lengths of sheet material 104 (e.g., from multiple bales 102) through converting assembly 114. When multiple guide channels are included, the guide channels may be horizontally and/or vertically offset from one another.

As also illustrated in FIGS. 3 and 4, converting cartridge 130 also includes at least one feed roller 134 that pulls sheet material 104 into converting assembly 114 and advances sheet material 104 therethrough. Feed roller(s) 134 may be configured to pull sheet material 104 with limited or no slip and may be smooth, textured, dimpled, and/or teethed. Each feed roller 134 may be actively rolled by an actuator or motor in order to advance sheet material 104 through converting assembly 114.

As best seen in FIG. 4, converting cartridge 130 includes one or more converting tools, such as a crosshead 150 and longheads 152, that perform the conversion functions (e.g., crease, bend, fold, perforate, cut, score) on sheet material 104 in order to create packaging templates 108. Some of the conversion functions may be made on sheet material 104 in a direction substantially perpendicular to the direction of movement and/or the length of sheet material 104. In other words, some conversion functions may be made across (e.g., between the sides of) sheet material 104. Such conversions may be considered "transverse conversions."

To perform the transverse conversions, crosshead 150 may move along at least a portion of the width of converting cartridge 130 in a direction generally perpendicular to the direction in which sheet material 104 is fed through converting assembly 114 and/or the length of sheet material 104. In other words, crosshead 150 may move across sheet material 104 in order to perform transverse conversions on sheet material 104. Crosshead 150 may be movably mounted on a track to allow crosshead 150 to move along at least a portion of the width of converting cartridge 130.

Crosshead 150 may include one or more converting instruments, such as a cutting wheel and/or a creasing wheel, which may perform one or more transverse conversions on sheet material 104. More specifically, as crosshead 150 moves back and forth over sheet material 104, a cutting wheel and/or a creasing wheel may create creases, bends, folds, perforations, cuts, and/or scores in sheet material 104.

In addition to being able to create transverse conversions with crosshead 150, conversion functions may also be made on sheet material 104 in a direction substantially parallel to the direction of movement and/or the length of sheet material 104. Conversions made along the length of and/or generally parallel to the direction of movement of sheet material 104 may be considered "longitudinal conversions."

Longheads 152 may be used to create the longitudinal conversions on sheet material 104. More specifically, longheads 152 may be selectively repositioned along the width of converting cartridge 130 (e.g., back and forth in a direction that is perpendicular to the length of sheet material 104) in order to properly position longheads 152 relative to the sides of sheet material 104. By way of example, if a longitudinal crease or cut needs to be made two inches from one edge of sheet material 104 (e.g., to trim excess material off of the edge of sheet material 104), one of longheads 152 may be moved perpendicularly across sheet material 104 to properly position longhead 152 so as to be able to make the cut or crease at the desired location. In other words, longheads 152 may be moved transversely across sheet material 104 to position longheads 152 at the proper locations to make the longitudinal conversions on sheet material 104.

Longheads 152 may include one or more converting instruments, such as a cutting wheel and/or a creasing wheel, which may perform the longitudinal conversions on sheet material 104. More specifically, as sheet material 104 moves underneath longhead 152, the cutting wheel and/or creasing wheel may create creases, bends, folds, perforations, cuts, and/or scores in sheet material 104.

A control system can control the operation of the converting machine 106. More specifically, the control system can control the movement and/or placement of the various components of the converting machine 106. For instance, the control system can control the rotational speed and/or direction of the feed rollers 134 in order to govern the direction (i.e., forward or backward) the sheet material 104 is fed and/or the speed at which the sheet material 104 is fed through the converting machine 106. The control system can also govern the positioning and/or movement of the converting tools 150, 152 so that the converting tools 150, 152 perform the conversion functions on the desired locations of the sheet material 104.

The control system may be incorporated into converting machine 106. In other embodiments, converting machine 106 may be connected to and in communication with a separate control system, such as a computer, that controls the operation of converting machine 106. In still other embodiments, portions of the control system may be incorporated into converting machine 106 while other portions of the control system are separate from converting machine 106. Regardless of the specific configuration of the control system, the control system can control the operations of converting machine 106 that form box templates 108 out of sheet material 104.

As illustrated in FIGS. 3 and 4 and discussed in greater detail below, converting machine 106 can include a fanfold crease sensing mechanism 200 (also referred to as sensing mechanism 200) that is configured to detect fanfold creases in sheet material 104 as sheet material 104 is fed into converting machine 106. After the sensing mechanism 200 detects the fanfold creases in sheet material 104, the control system can cause converting machine 106 to alter the portion of sheet material 104 used to create box template 108. For instance, in some embodiments, the control system can cause converting machine 106 to cut off the portions of sheet material 104 that include the fanfold creases so the fanfold creases do not end up in specific portions of the box template 108. In other embodiments, the control system can cause the converting machine 106 to cut off a leading edge of sheet material 104 so as to shift the location of the fanfold creases within the box template 108.

Figure 5:
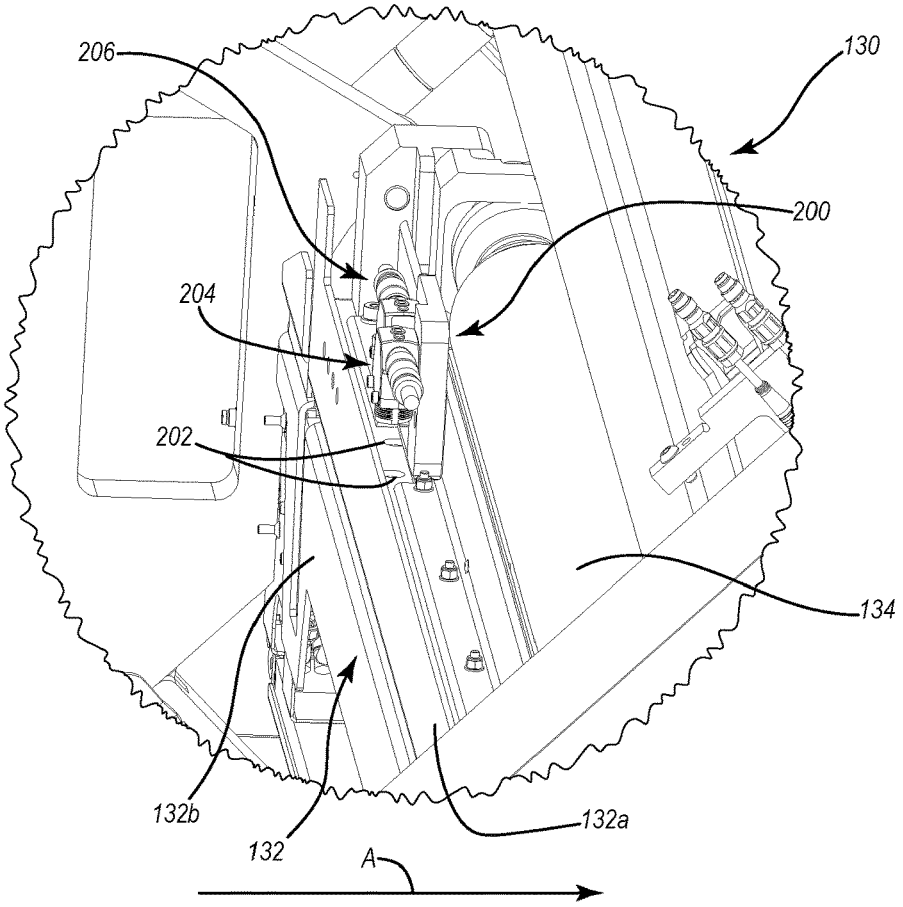
FIGS. 5 and 6 are side and front perspective views of a fanfold crease sensing mechanism for use with the converting cartridge of FIG. 3.
Figure 6:
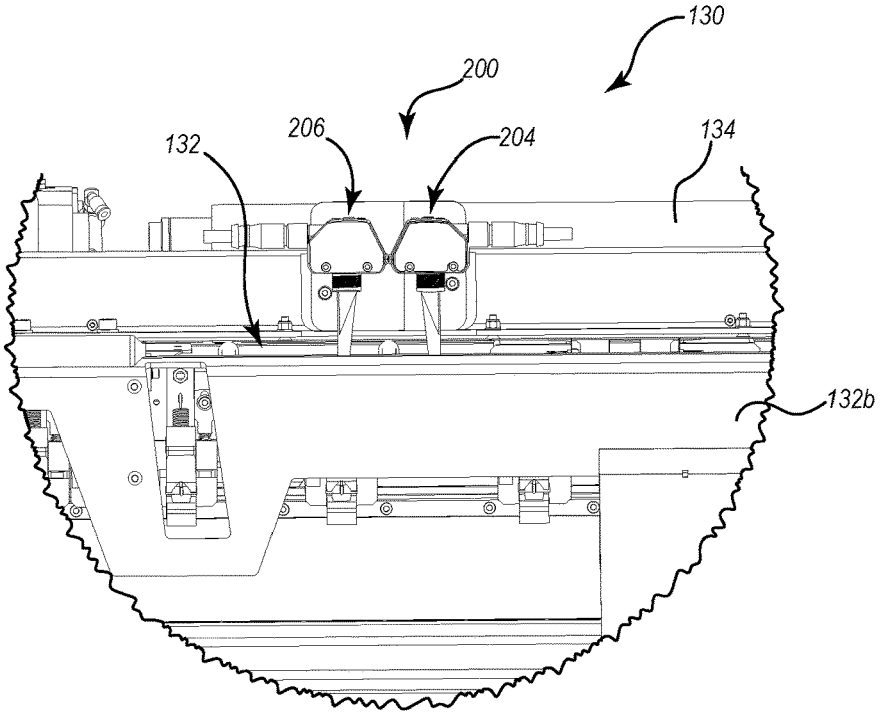

With continued attention to FIGS. 3 and 4, attention is also now directed to FIGS. 5 and 6, which illustrate an example embodiment of fanfold crease sensing mechanism 200. In the illustrated embodiment, sensing mechanism 200 is mounted adjacent to guide channel 132 and is configured to monitor sheet material 104 as sheet material 104 is fed into converting machine 106 through guide channel 132. To enable sensing mechanism 200 to monitor sheet material 104 as sheet material passes through guide channel 132, guide plate 132*a* and/or 132*b* may include one or more openings 202 therethrough. Sensing mechanism 200 may interact with sheet material 104 through openings 202 to detect fanfold creases in sheet material 104.

In the illustrated embodiment, sensing mechanism 200 includes a first sensor 204 and a second sensor 206. As best seen in FIG. 5, sensors 204, 206 are mounted within converting machine 106 so that first sensor 204 and second sensor 206 are offset from one another in the direction that sheet material 104 is feed through converting machine 106 (indicated by arrow A in FIG. 5). This offset of the sensors 204, 206 may be referred to as a longitudinal offset or feed direction offset. The sensors 204, 206 may be longitudinally offset from one another such that only one of the sensors 204, 206 is disposed above a fanfold crease at a given time. In some embodiments, it can be desirable to position the sensors 204, 206 as close together as possible while only one of the sensors 204, 206 is disposed above the fanfold crease at a time. In some embodiments, the closer the sensors 204, 206 are to each other (e.g., the shorter the longitudinal offset), the more tolerant the sensors 204, 206 become. In other words, by positioning the sensors 204, 206 closer together (while still being spaced apart far enough that only one of the sensors 204, 206 is above a fanfold crease at a time), there is less of a chance that movement of the sheet material 104 (e.g., up and down, closer to or further from the sensors 204, 206) will prevent accurate detection of the fanfold creases. In some embodiments, the sensors 204, 206 have a longitudinal offset of about 5 mm, about 7 mm, about 10 mm, or more, or any value therebetween.

The sensors 204, 206 may communicate with the control system. For instance, each of the sensors 204, 206 may communicate signals to the control system that indicate whether the sensors 204, 206 detect the potential presence of a fanfold crease. The control system may include a filter or algorithm that compares the signals from the sensors 204, 206, and optionally other system data (e.g., the rotational speed and/or direction of the feed rollers 134, the speed the sheet material 104 is being fed through the converting machine 106, etc.) to determine whether a fanfold crease is present or has been detected.

By way of example, the filter or algorithm of the control system may determine whether both sensors 204, 206 have detected the potential presence of a fanfold crease. If both sensors 204, 206 have detected the potential presence of a fanfold crease, the filter or algorithm may determine whether each sensor 204, 206 has detected the presence of the same potential fanfold crease. For instance, the filter or algorithm of may determine a temporal displacement (e.g., a time differential) between the signals from each of the sensors 204, 206 that indicated the potential presence of a fanfold crease.

The filter or algorithm may use the temporal displacement and other system data to determine whether the sensors 204, 206 have detected the same potential fanfold crease. For instance, the filter or algorithm may use the temporal displacement and the speed at which the sheet material 104 is being fed through the converting machine 106 to determine whether the sensors 204, 206 have detected the same potential fanfold crease. If filter or algorithm determines that the sensors 204, 206 have detected the same potential fanfold crease within a predetermined distance, the filter or algorithm will determine that the sensors 204, 206 have detected an actual fanfold crease. The predetermined distance can vary between embodiments. For instance, the predetermined distance may be about 5 mm, about 7 mm, about 10 mm, about 12 mm, about 15 mm, or more, or any value therebetween. In some embodiments, the predetermined distance may be adjustable (e.g., by a user, based on the thickness of the sheet material, etc.).

As illustrated in FIGS. 5 and 6, sensors 204, 206 may optionally be offset from one another in a direction generally perpendicular or transverse to the feed direction. In other embodiments, sensors 204, 206 may not be offset from one another in a direction perpendicular or transverse to the feed direction. For example, sensor 206 may be positioned directly behind sensor 204 (in the feed direction).

The sensors 204, 206 may detect the presence or absence of sheet material 104 within the converting machine 106, and more particularly within guide channel 132. The sensors 204, 206 may communicate to the control system the presence or absence of sheet material 104. If the sensors 204, 206 do not detect the presence of sheet material 104, the control system can provide an alert that sheet material 104 needs to be loaded into converting machine 106. In some embodiments, the system may include a feed changer that selectively feeds different sheet materials into the converting machine 106. The sensors 204, 206 may also detect whether the sheet material from the feed changer is loaded or unloaded correctly and the control system may provide alerts regarding the same.

The sensors 204, 206 can also detect the presence and/or location of fanfold creases in sheet material 104. When sheet material 104 is unfolded from a bale 102, the unfolded fanfold creases may take the form of depressions or projections on or in the surface of the sheet material 104. As sheet material 104 is fed into converting machine 106, and particularly through guide channel 132, sensor 204, 206 may detect the depressions or projections on or in the surface of the sheet material 104. Detection of such depressions or projections provides an indication of the presence and location of fanfold creases in sheet material 104.

The control system can use the detected locations of the fanfold creases to predict the locations of upcoming fanfold creases. Typical sheet material bales 102 have relatively consistent layer dimensions (e.g., distances between fanfold creases on opposing ends of a layer). As a result, the fanfold creases are relatively evenly spaced apart. For instance, some bales 102 have fanfold creases that are spaced apart by about 47 inches.

Using the detected and/or predicted locations of the fanfold creases, the control system can cause the converting machine 106 to cut off portions of sheet material 104 and/or adjust which portions of sheet material 104 are used to form box templates 108. For instance, if the sensors 204, 206 detect a fanfold crease close to the leading end of sheet material 104, the control system can cause the converting machine 106 to cut off the leading portion of sheet material 104 that includes the fanfold crease. By cutting off the leading portion of sheet material 104 that includes the fanfold crease, the risk of the leading edge of the sheet material 104 curling or folding and jamming the converting machine 106 are greatly reduced.

In some cases, the leading end of the sheet material 104 is used to form a glue tab portion of a box template 108. If a fanfold crease extends through the glue tab, the glue tab may curl or fold or have reduced strength, making it difficult to securely attach the glue tab to a panel of the box template 108. For instance, a glue tab with a fanfold crease may not lie flat, which can make it difficult to securely attach the glue tab to another portion of the box template 108 because the glue tab will try to curl or fold away from the other portion of the box template. As a result, a glue joint formed with a glue tab having a fanfold crease may prematurely fail. Similarly, the leading end of the sheet material 104 may be used to form a panel of the box template to which a glue tab is to be attached. If a fanfold crease is located near an edge of the panel to which the glue tab is to be secured, the edge of the panel may curl or fold or have reduced strength, making it difficult to securely attach the glue tab to the panel. To avoid such issues, the control system can cause the converting machine 106 to cut off the leading portion of the sheet material 104 in which the sensors 204, 206 detected the fanfold crease.

In some embodiments, if the sensors 204, 206 detect the presence of a fanfold crease within a predetermined or user configurable range of the leading edge of sheet material 104, the control system can cause the converting machine 106 to cut off the predetermined or user configurable amount of the leading edge of the sheet material 104, including the fanfold crease therein. For instance, in some embodiments, the predetermined range may be the first 25 mm, 50 mm, 75 mm, 100 mm, or 150 mm of the sheet material 104. In such cases, the control system can cause the converting machine 106 to cut off the first 25 mm, 50 mm, 75 mm, 100 mm, or 150 mm of the leading edge of the sheet material 104, including the fanfold crease therein. The box template 108 may then be formed with the following sheet material 104 that does not include a fanfold crease within the predetermined or user configurable range of the leading edge of sheet material 104.

As noted above, fanfold creases are typically relatively evenly spaced apart from one another. As a result, once sensors 204, 206 detect the location of a fanfold crease in sheet material 104, the control system can predict the locations of upcoming fanfold creases. Continually detecting the location of fanfold creases (via sensors 204, 206) and predicting the locations of upcoming fanfold creases can allow for the avoidance of fanfold creases in areas of box template 108 other than just near the leading end thereof.

For instance, detection of fanfold creases (via sensors 204, 206) and prediction of future fanfold crease locations can allow the control system to determine if a fanfold crease would be located within a predetermined range (e.g., 25 mm, 50 mm, 75 mm, 100 mm, or 150 mm) or user configurable range of the end of a box template 108. Having a fanfold crease near the trailing edge (e.g., within the last 25 mm, 50 mm, 75 mm, 100 mm, or 150 mm) of a box template 108 may pose similar problems to those discussed above when a fanfold crease is near a leading end of the box template 108. If the control system determines that a fanfold crease would be located within a predetermined range (25 mm, 50 mm, 75 mm, 100 mm, or 150 mm) or user configurable range of the last or trailing edge of a box template 108, the control system can cause the converting machine 106 to cut the predetermined range (e.g., 25 mm, 50 mm, 75 mm, 100 mm, or 150 mm) or user configurable range off of the leading end of the sheet material 108 and use the following sheet material 104 to make the box template 108. Cutting the predetermined range (e.g., first 25 mm, 50 mm, 75 mm, 100 mm, or 150 mm) or user configuration range off of the leading end of the sheet material 108 will shift where in the box template 108 the fanfold crease is located.

By way of example, if the control system determines that an upcoming fanfold crease would be located within 50 mm of the trailing end of a box template 108, the control system can cause the converting machine 106 to cut 50 mm off of the leading end of the sheet material 104. By cutting 50 mm off of the leading end of the sheet material 104 and using the subsequent sheet material 104 to form the box template 108, the location of the upcoming fanfold crease is shifted further into the box template (e.g., more than 50 mm away from the trailing end thereof). When the fanfold crease is shifted away from the trailing end, the likelihood that the fanfold crease will pose a problem decreases. This can be due to the fanfold crease not being located where a glue joint is to be made or attached. Furthermore, when a fanfold crease is located further away from an edge, the sheet material 104 is less likely to curl or fold in an undesirable manner.

Detecting and predicting the locations of fanfold creases can also enable the system 100 to avoid fanfold creases being located in box templates at other potentially problematic areas. For instance, the control system may cause the converting assembly 106 to cut a length of sheet material 104 off of the leading end thereof so as to shift the location of an upcoming fanfold crease away from a crease between box template panels, flaps, or the like.

Detecting and predicting the locations of fanfold creases can also enable the system 100 to create box templates 108 is different orders to avoid fanfold creases being located in undesirable locations in the box templates 108. For instance, if the control system determines that an upcoming fanfold crease would be located in an undesirable location in a first box template but not would not be in an undesirable location in a second box template (e.g., due to the second box template having different dimensions), the control system can have the converting machine 106 make the second box template before the first box template.

As noted above, the sensing mechanism 200 includes two sensors (i.e., first and second sensors 204, 206) that are offset from one another in the feeding or longitudinal direction. The longitudinal offset between the sensors 204, 206 allows for the readings of the sensors 204, 206 to be compared to one another to determine the presence and location of a fanfold crease.

Figure 7:
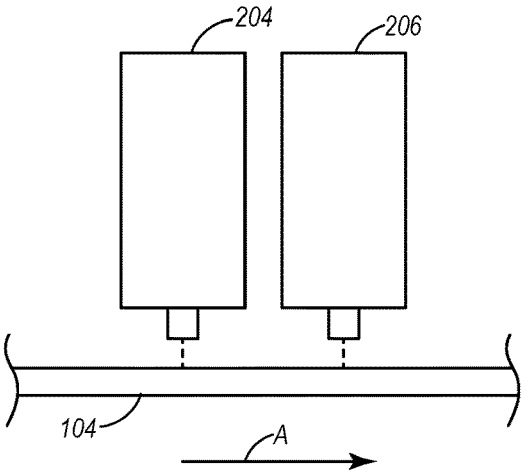
FIGS. 7-9 illustrate a schematic of a fanfold sensing mechanism detecting the presence and location of a fanfold crease in sheet material.

More specifically, as the sheet material 104 advances past the sensing mechanism 200, each of the sensors 204, 206 will obtain a reading regarding the surface of the sheet material 104. For instance, the readings may indicate the distance between the sensors 204, 206 and the surface of the sheet material 104. When substantially flat portions of the sheet material 104 (e.g., portions without fanfold creases) advance past the sensors 204, 206, as illustrated in FIG. 7, the sensors 204, 206 provide readings that are the same or within a predetermined tolerance.

Figure 8:
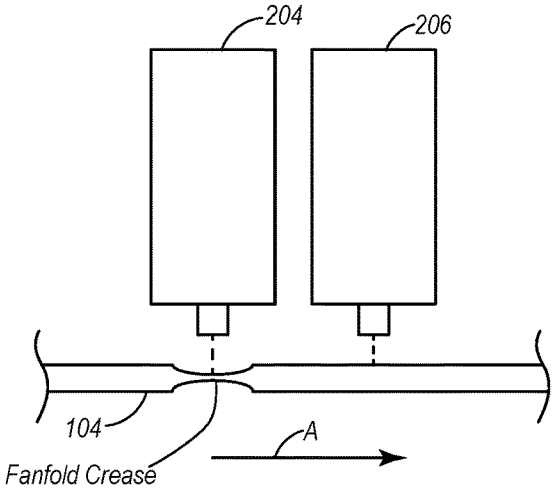

In contrast, when a fanfold crease advances past the sensors 204, 206, the sensors 204, 206 will detect a change in the surface of the sheet material 104. For instance, as illustrated in FIG. 8, as the fanfold crease advances under sensor 204, sensor 204 will provide a first reading and sensor 206 will provide a second reading that is different than the first reading. The different readings indicate the presence of the fanfold crease.

Figure 9:
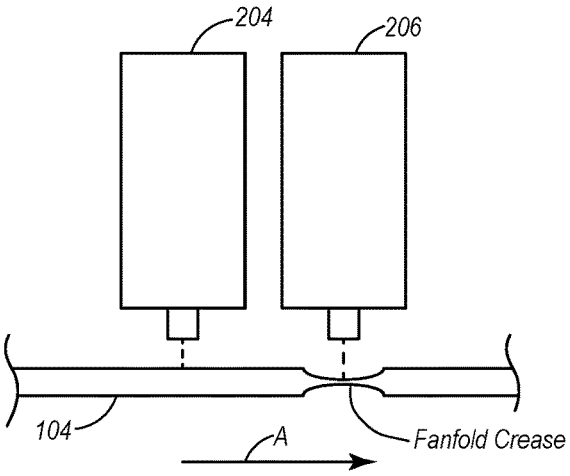

As the sheet material 104 continues to advance, as illustrated in FIG. 9, the sensor 206 will provide a reading that is different than the reading of the first sensor. In some embodiments, this can provide a verification of the location of the fanfold crease. In other embodiments, the readings from the two sensors can allow for vertical movement of the sheet material 104. As the sheet material 104 advances through the guide channel 132, the sheet material 104 may move up and down slightly because the upper and lower guide plates 132*a*, 132*b* are spaced apart by a distance greater than the thickness of the sheet material 104. Using two offset sensors 204, 206 allows for fanfold creases to be detected even if the sheet material 104 moves vertically.

More specifically, rather than maintaining the sheet material 104 in a vertical position and using that position as a baseline for taking readings, one of the sensors 204, 206 will provide a baseline reading that reflects the flat surface of the sheet material 104 while the other sensor 204, 206 will provide a reading related to the fanfold crease. For instance, as shown in FIG. 8, the sensor 206 provides a reading for the flat surface of sheet material 104 regardless of the vertical position of the sheet material 104. The sensor 204, as shown in FIG. 8, provides a reading for the fanfold crease. The difference in the two readings indicates the presence of the fanfold crease.

Additionally, the location of the fanfold crease may be determined using an encoder or similar device to track the feed position of the sheet material 108. When the sensors 204, 206 detect the presence of a fanfold crease, the control system may use the current feed position (determined with the encoder) to determine the location of the fanfold crease.

As the sheet material 104 continues to advance to the position shown in FIG. 9, the sensor 204 will provide the baseline reading based on the flat surface of the sheet material (again regardless of the vertical position of the sheet material 104). The sensor 206 will now provide a reading for the fanfold crease. Again, the difference in the two readings indicates the presence and location of the fanfold crease.

The sensors 204, 206 may take various forms. For instance, in some embodiments the sensors 204, 206 take the form of lasers that are able to detect the distance to the surface of the sheet material 104. In other embodiments, the sensors 204, 206 may take the form of mechanical devices that can detect changes in the surface of the sheet material 104. For instance, a mechanical sensor may contact the surface of the sheet material 104 and detect changes in the surface of the sheet material 104 (e.g., depressions/projections of a fanfold crease) by increases or decreases in the position of the mechanical sensor, etc. In still other embodiments, the sensors 204, 206 may take the form of optical sensors or vision (camera) systems.

Although the illustrated embodiment has shown both of sensors 204, 206 being positioned above the sheet material 104, this is merely exemplary. In other embodiments, a sensing mechanism may include two sensors positioned below the sheet material 104. In still other embodiments, a sensing mechanism may include one sensor positioned above the sheet material 104 and a second sensor positioned below the sheet material 104.

Regardless of the specific type of sensors used or the location of the sensors, the sensors may be able to provide readings with a predetermined accuracy. For example, fanfold creases typically have depths of between about 0.5 mm and about 4 mm. In order to accurately detect the fanfold creases, the sensors may have an accuracy level of about two or three times less than the depth of the fanfold creases. Thus, for instance, the sensors may provide readings with an accuracy of about 0.2 mm, 0.5 mm, 1 mm, 1.25 mm, 1.5 mm, or 2 mm. In other words, the sensors may be able to detect depressions or projections on the surface of the sheet material 104 that are 0.5 mm, 1 mm, 1.25 mm, 1.5 mm, 2 mm, or 4 mm deep or tall.

Additionally, the sensors may be able to detect the fanfold creases even when the sheet material 104 is being advanced into the converting machine 106 and past the sensors at a relatively fast rate. For instance, the sensors may be able to detect the fanfold creases when the sheet material 104 is being advanced at a rate of 0.25 m/s, 0.5 m/s, 0.75 m/s, 1 m/s. 1.25 m/s, or 1.5 m/s.

While the sensing mechanism 200 has been shown and described in connection with a particular converting machine (i.e., converting machine 106), it will be appreciated that sensing mechanism 200 may be incorporated into a variety of different converting machines or other sheet material processing equipment.

It will be appreciated that relative terms such as "horizontal," "vertical," "upper," "lower," "raised," "lowered," "above," "below" and the like, are used herein simply by way of convenience. Such relative terms are not intended to limit the scope of the present invention. Rather, it will be appreciated that converting assembly 114 may be configured and arranged such that these relative terms require adjustment.

The present invention may be embodied in other specific forms without departing from its spirit or essential characteristics. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A converting machine used to convert sheet material into packaging templates for assembly into boxes or other packaging, the converting machine comprising:

a converting assembly configured to perform one or more transverse conversion functions and one or more longitudinal conversion functions on the sheet material as the sheet material moves through the converting machine in a feed direction, the one or more transverse conversion functions and the one or more longitudinal conversion functions being selected from the group consisting of creasing, bending, folding, perforating, cutting, and scoring, to create the packaging templates; and a fanfold crease sensing mechanism configured to detect the presence and location of fanfold creases that exist in the sheet material prior to the sheet material entering the converting machine, the fanfold creases comprising depressions or projections in a surface of the sheet material between leading and trailing ends of the sheet material, the fanfold crease sensing mechanism comprising a first sensor and a second sensor, the first sensor and the second sensor being configured to cooperate to detect the presence and location of the fanfold creases and distinguish between the presence and location of a fanfold crease and movement of the sheet material closer to or further away from the first sensor or the second sensor, wherein:

the first sensor and the second sensor are offset from one another in the feed direction; or the first sensor is positioned above the sheet material and the second sensor is positioned below the sheet material.

2. The converting machine of claim 1, wherein the first and second sensors are offset from one another in the feed direction such that only one of the first sensor and the second sensor are positioned above a fanfold crease at a given time and such that the first and second sensors are spaced apart by at least one of the following:

a distance of about half of a width of a fanfold crease; or about 7 mm.

3. The converting machine of claim 1, wherein the first and second sensors comprise lasers.

4. The converting machine of claim 1, wherein the first and second sensors comprise mechanical, optical, or vision sensors.

5. The converting machine of claim 1, wherein the first and second sensors are mounted on the converting assembly.

6. The converting machine of claim 1, wherein both the first and second sensors are positioned above the sheet material.

7. The converting machine of claim 1, wherein both the first and second sensors are positioned below the sheet material.

8. The converting machine of claim 1, wherein one of the first and second sensors is positioned above the sheet material and the other of the first and second sensors is positioned below the sheet material.

9. The converting machine of claim 1, further comprising a control system, the control system being configured to compare a reading from the first sensor to a reading from the second sensor to determine the presence and location of a fanfold crease in the sheet material.

10. The converting machine of claim 9, wherein the control system causes the converting assembly to cut off the leading end of the sheet material if the sensing mechanism detects the presence of a fanfold crease within a predetermined or user configurable range of a leading edge of the sheet material.

11. The converting machine of claim 9, wherein the control system causes the converting assembly to cut off the leading end of the sheet material if the control system predicts that a fanfold crease will be within a predetermined or user configurable range of a trailing edge of a packaging template.

12. The converting machine of claim 1, wherein the first and second sensors are offset from one another in the feed direction such that only one of the first sensor and the second sensor are positioned above a fanfold crease at a given time and such that the first and second sensors are spaced apart by at least one of the following:

a distance of about half of a width of a fanfold crease; or about 7 mm.

13. A method of converting sheet material into packaging templates for assembly into boxes or other packaging, the method comprising:

detecting with a plurality of offset sensors the presence and location of a fanfold crease in the sheet material, the fanfold crease comprising a depression or projection disposed in a surface of the sheet material between leading and trailing ends of the sheet material, at least two sensors of the plurality of offset sensors being disposed on the same side of the sheet material to detect the fanfold crease;

distinguishing between the presence and location of a fanfold crease and movement of the sheet material closer to or further away from the plurality of sensors;

determining that the fanfold crease is within a predetermined or user configurable distance of a leading edge of the sheet material;

cutting off a predetermined or user configurable length from a leading end of the sheet material to remove the fanfold crease; and performing one or more conversion functions on remaining sheet material to form the packaging template.

14. The method of claim 13, wherein the predetermined or user configurable distance comprises 25 mm, 50 mm, 75 mm, 100 mm, or 150 mm.

15. The method of claim 13, wherein the predetermined or user configurable length comprises 25 mm, 50 mm, 75 mm, 100 mm, or 150 mm.

16. The method of claim 13, wherein detecting with a plurality of offset sensors the presence and location of a fanfold crease in the sheet material comprises comparing a reading from one of the sensors to a reading from another of the sensors.

17. A method of converting sheet material into packaging templates for assembly into boxes or other packaging, the method comprising:

detecting with a plurality of offset sensors the presence and location of a fanfold crease in the sheet material;

predicting the location of a subsequent fanfold crease in the sheet material;

determining that the subsequent fanfold crease would be within a predetermined distance of a trailing edge of a packaging template formed from the sheet material;

cutting off a predetermined length from a leading end of the sheet material to move the subsequent fanfold crease further from the trailing edge than the predetermined distance; and performing one or more conversion functions on remaining sheet material to form the packaging template.

18. The method of claim 17, wherein the predetermined distance comprises 25 mm, 50 mm, 75 mm, 100 mm, or 150 mm.

19. The method of claim 17, wherein the predetermined length comprises 25 mm, 50 mm, 75 mm, 100 mm, or 150 mm.

20. The method of claim 17, wherein detecting with a plurality of offset sensors the presence and location of a fanfold crease in the sheet material comprises comparing a reading from one of the sensors to a reading from another of the sensors.

21. A converting machine used to convert sheet material into packaging templates for assembly into boxes or other packaging, the converting machine comprising:

a converting assembly configured to perform one or more transverse conversion functions and one or more longitudinal conversion functions on the sheet material as the sheet material moves through the converting machine in a feed direction, the one or more transverse conversion functions and the one or more longitudinal conversion functions being selected from the group consisting of creasing, bending, folding, perforating, cutting, and scoring, to create the packaging templates; and a fanfold crease sensing mechanism configured to detect the presence and location of fanfold creases that exist in the sheet material prior to the sheet material entering the converting machine, the fanfold creases comprising depressions or projections disposed in a surface of the sheet material between leading and trailing ends of the sheet material, the fanfold crease sensing mechanism comprising a first sensor and a second sensor, the first sensor and the second sensor being configured to cooperate to detect the presence and location of the fanfold creases and distinguish between the presence and location of a fanfold crease and movement of the sheet material closer to or further away from the first sensor or the second sensor, and the first sensor and the second sensor being disposed on the same side of the sheet material to detect the fanfold creases and being offset from one another in the feed direction.

* * * * *